US011335524B2

(12) United States Patent
Zhang et al.

(10) Patent No.: US 11,335,524 B2
(45) Date of Patent: May 17, 2022

(54) ELECTRICAL SWITCHING SYSTEM

(71) Applicant: ABB Schweiz AG, Baden (CH)

(72) Inventors: Zichi Zhang, Västerås (SE); Stefan Valdemarsson, Lidköping (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/312,491

(22) PCT Filed: Dec. 18, 2019

(86) PCT No.: PCT/EP2019/085822

§ 371 (c)(1),
(2) Date: Jun. 10, 2021

(87) PCT Pub. No.: WO2020/127401

PCT Pub. Date: Jun. 25, 2020

(65) Prior Publication Data

US 2021/0358701 A1 Nov. 18, 2021

(30) Foreign Application Priority Data

Dec. 19, 2018 (EP) ..... 18213933

(51) Int. Cl.
*H01H 33/18* (2006.01)
*H01H 33/42* (2006.01)
*H01H 33/53* (2006.01)

(52) U.S. Cl.
CPC ..... *H01H 33/185* (2013.01); *H01H 33/42* (2013.01); *H01H 33/53* (2013.01)

(58) Field of Classification Search
CPC ..... H01H 33/185; H01H 33/42; H01H 33/53
(Continued)

(56) References Cited

U.S. PATENT DOCUMENTS 1,784,760 A 12/1930 Joseph
1,872,387 A 8/1932 Baker et al.
(Continued)

FOREIGN PATENT DOCUMENTS

CN 2924763 Y 7/2007

OTHER PUBLICATIONS

Extended European Search Report; Application No. 18213933.7; Completed: May 20, 2019; dated May 28, 2019; 9 Pages.
(Continued)

*Primary Examiner* — Kevin J Comber
(74) *Attorney, Agent, or Firm* — Whitmyer IP Group LLC

(57) ABSTRACT

An electrical switching device includes: a main contact arrangement including a fixed contact and a movable contact, a plurality of splitter plates, each having a loop structure, the splitter plates being coaxially stacked with respect to their loop structure to form a stack, wherein one splitter plate is a first outermost plate and another splitter plate is a second outermost plate, a first arc runner electrically connected to the second outermost plate and a second arc runner electrically connected to the first outermost plate, the first and second arc runners being configured to direct a main arc from the main contact arrangement to the stack to thereby split the main arc into a plurality of secondary arcs between the splitter plates, and a first drive coil electrically connected to the second arc runner and to the movable contact or to the first arc runner and to the fixed contact.

19 Claims, 3 Drawing Sheets

(58) Field of Classification Search
USPC ..... 218/40
See application file for complete search history.

(56) References Cited

U.S. PATENT DOCUMENTS

| | | | | |
|---|---|---|---|---|
| 1,932,061 | A | 10/1933 | Baker | |
| 2,625,627 | A * | 1/1953 | Grepe | H01H 9/44 218/36 |
| 2,831,946 | A | 4/1958 | Wood | |
| 3,201,551 | A | 8/1965 | Mercier | |
| 3,629,533 | A | 12/1971 | Kuznestsov et al. | |
| 3,947,649 | A * | 3/1976 | Hertz | H01H 33/7007 218/22 |
| 4,052,576 | A | 10/1977 | Smith | |
| 4,079,219 | A | 3/1978 | Weston | |
| 4,206,330 | A | 6/1980 | Mcconnell et al. | |
| 6,100,491 | A | 8/2000 | Moldovan | |
| 2001/0015879 | A1 * | 8/2001 | Benard | H01H 9/42 361/13 |
| 2012/0261382 | A1 | 10/2012 | Fasano | |

OTHER PUBLICATIONS

International Search Report and Written Opinion of the International Searching Authority; Application No. PCT/EP2019/085822; Completed: Feb. 7, 2020; dated Feb. 21, 2020; 12 Pages.
Chinese Office Action; Application No. 2019800821057; dated Sep. 30, 2021; 9 Pages.
Indian Office Action; Application No. 202147031437; dated Feb. 23, 2022; 5 Pages.

* cited by examiner

ELECTRICAL SWITCHING SYSTEM

TECHNICAL FIELD

The present disclosure generally relates to electrical switching systems for extinguishing an electric arc. In particular it relates to an electrical switching system of a rotating arc type.

BACKGROUND

When interrupting a current, either in AC systems at natural zero crossing or in DC systems at zero crossings created by injection currents, a recovery voltage will occur across the post arc. A conventional approach to solve this problem is to introduce an arc chamber with several splitter plates where the are, running from the main contacts into the arc chamber, will be divided into several short arcs in order to achieve an effective cooling and thereby withstand the fast-rising recovery voltage.

At conventional splitter plates the arcs are only allowed to move for short distances. They thereby become stationary and consequently cause severe melting damages on the surface of each splitter plate. This melting has several negative consequences. For example, metal vapour in the post arc column will weaken the ability to withstand the recovery voltage. Moreover, the old foot point of the arc is still molten when recovery voltage is applied.

The short post arc column will thereby not be cooled effectively. Additionally, melted craters and droplets from the surface of the splitter plates can cause short circuits between plates. Hence at higher currents, typically larger than 5-10 kA, the gaps between plates have to be increased, leading to worsened recovery voltage withstand.

One solution to the above problem is to use a so-called rotating arc chamber. Rotating arc chambers are disclosed in U.S. Pat. Nos. 1,872,387 A, 1,784,760 A, and 1,932,061 A.

U.S. Pat. No. 1,872,387 A discloses a circuit breaker having a blow-out magnet winding. The winding surrounds the path of the arc and provides a magnetic field for forcing the arc drawn between the contacts into the deionizing plates. The winding is energized when the contacts are separated. The current is forced to flow through the winding. The magnetic field set up by the winding forces the arc to move into the spaces between the deionizing plates.

U.S. Pat. No. 1,784,760 A discloses a circuit breaker having an arcing chamber which comprises deionizing sheets. Since the magnetic field transverse to an electric are always moves the arc in a path normal to the lines of force composing that field, this radial field causes the arcs between the plates of the deionizing structure to travel around it continuously in a circular path as long as the arm remains in existence. The radial field is obtained by means of suitable exciting coils arranged at intervals between the sheets to give a field of the required shape and strength.

U.S. Pat. No. 1,932,061 A discloses a circuit breaker comprising deionizing sheets. The sheets have a tapering slot and a radial slot. Excitation coils are used to cause the arcs between the plates of the deionizing structure to travel around it continuously in a circular path as long as the arcs remain in existence. The radial field is obtained by means of suitable exciting coils arranged at intervals between the sheets to give the field the required shape and strength.

SUMMARY

In view of the above, an object of the present disclosure is to provide an electrical switching system which solves, or at least mitigates, the problems of the prior art.

There is hence provided an electrical switching device comprising: a main contact arrangement comprising a fixed contact and a movable contact, a plurality of splitter plates, each having a loop structure, the splitter plates being coaxially stacked with respect to their loop structure to form a stack of splitter plates, wherein one of the splitter plates of the stack of splitter plates is a first outermost splitter plate and another one of the splitter plates of the stack of splitter plates is a second outermost splitter plate, a first arc runner electrically connected to the second outermost splitter plate and a second arc runner electrically connected to the first outermost splitter plate, the first arc runner and the second arc runner being configured to direct a main arc from the main contact arrangement to the stack of splitter plates to thereby split the main arc into a plurality of secondary arcs between the splitter plates, and a first drive coil electrically connected to the second arc runner and to the movable contact or to the first arc runner and to the fixed contact, wherein the first drive coil has a first force increasing coil portion extending in parallel with the first arc runner in a direction towards the splitter plates such that the first force increasing coil portion is able to carry current in the same direction as and in parallel with a main current flow in the first arc runner to increase the magnetic field to thereby increase the Lorentz force applied to the main arc between the first arc runner and the second arc runner, wherein the first drive coil, when energised, is configured to create a blowing magnetic field in the stack of splitter plates, causing the secondary arcs to move circumferentially along the loops structures of the splitter plates.

The electrical switching device may thereby be made substantially simpler and smaller. This effect may be obtained due to the dual functionality of the first drive coil. The first drive coil firstly provides a strong enough Lorentz force to attract the main arc into the arc chamber so that it splits into secondary arcs, especially for non-ferrous splitter plates. This is achieved by the increase of the magnetic field in the region of the first arc runner, which is generated by the current in the first arc runner and by the parallel and same-directional current in the first force increasing coil portion. Secondly, the first drive coil also provides a blowing magnetic field which causes rotation of the secondary arcs, to thereby protect the splitter plates from overheating.

An advantage of using moving/rotating arcs for interruption purposes is the transformation from thermal emission of charges at the foot point of the arc to so-called field emission. At field emission the metal surface need not be heated in order to melt the surface; there will be cold cathode/anode arcs.

The recovery voltage withstand of cold cathode arcs is superior to arcs from melted surfaces. In this way the number of arcing gaps can be reduced considerably as can the length of the gaps because no craters are formed on the surfaces. The total height of the arc chamber thus becomes much lower.

Hence, the gaps between the annular splitter plates become smaller, even at high currents such as 20 kA. The thickness of the annular splitter plate becomes thinner as there is no surface melting. Each gap can withstand higher voltage; for example 1500 Vdc need 3-5 gaps. Each gap can withstand a higher voltage derivative, i.e. steeper recovery voltage. Moreover, lower number of gaps makes the voltage distribution between gaps more even. Therefore, the size of the stack of splitter plates may be greatly reduced. Alternatively, the number of splitter plates can be increased while the same size of the arc chamber may be maintained. Moreover, arc erosion on the annular splitter plates could be mitigated greatly, thereby increasing the electrical lifetime of the electrical switching device. Additionally, the arc breaking performance may be improved, particularly for electrical DC switching devices and the current and voltage ratings can be upgraded.

According to one embodiment the first drive coil is electrically connected to the first arc runner and the fixed contact, and an outer surface of the first arc runner and an outer surface of the second outermost splitter plate are provided with a layer of ferrous material. Generally, it is more difficult to mount the first drive coil in conjunction with the movable contacts. This configuration hence simplifies the assembly of the electrical switching device while providing and increasing the Lorentz force sufficiently to attract the main arc into the stack of splitter plates.

In case only one drive coil, i.e. the first drive coil, is provided in the electrical switching device, the number of turns should be increased compared to if two drive coils, i.e. the first drive coil and a second drive coil, are provided.

According to one embodiment an outer surface of the second arc runner and an outer surface of the first outermost splitter plate are provided with a layer of ferrous material. The magnetic field is thereby "warped", and a higher magnetic field can be directed into the stack of splitter plates. A higher blowing magnetic field for rotating the arc may thereby be provided inside the stack of splitter plates.

One embodiment comprises a second drive coil electrically connected to the second arc runner and to the movable contact, wherein the second drive coil has a second force increasing coil portion extending in parallel with the second arc runner in a direction towards the splitter plates such that the second force increasing portion is able to carry current in the same direction as and in parallel with a main current flow in the second arc runner to increase the magnetic field to thereby increase the Lorentz force applied to the arc between the first arc runner and the second arc runner.

The blowing magnetic field inside the stack of splitter plates may thereby be made more constant in the axial direction formed by the stacked loops, i.e. along the height of the stack of splitter plates.

According to one embodiment the second drive coil, when energised, is configured to create a blowing magnetic field in the stack of splitter plates, causing the secondary arcs to move circumferentially along the loop structures of the splitter plates.

According to one embodiment the splitter plates are made of a non-ferrous material. The secondary arcs move faster in a non-ferrous material.

According to one embodiment the non-ferrous material is copper or brass.

According to one embodiment the first drive coil is a first plate which has a spiral coil structure. This is a mechanically more stable solution than using a wire to form the first drive coil.

According to one embodiment the first plate a first stem portion axis, wherein the first stem portion transitions into the spiral coil structure in a first transition region, wherein the first transition region has a first inner coil surface which intersects the first stem portion axis with an angle of at most 80 degrees, such as at most 70 degrees. This design prevents the arc from blowing out from the arc chamber.

According to one embodiment the second drive coil is a second plate which has a spiral coil structure.

According to one embodiment the second plate a second stem portion having a second stem portion axis, wherein the second stem portion transitions into the spiral coil structure in a second transition region, wherein the second transition region has a second inner coil surface which intersects the second stem portion axis with an angle of at most 80 degrees, such as at most 70 degrees.

One embodiment comprises an arc chamber, wherein the stack of splitter plates forms part of the arc chamber, and wherein the arc chamber comprises cooling ducts. The cooling ducts form ventilation holes and reduce the gas pressure inside the arc chamber.

According to one embodiment the arc chamber comprises outer distancing elements and inner distancing elements, each inner distancing element being arranged concentrically with a corresponding outer distancing element, the outer distancing elements and the inner distancing elements being configured to distance adjacent splitter plates from each other, wherein the outer distancing elements and inner distancing elements are provided with the cooling ducts.

According to one embodiment the arc chamber comprises an external housing provided with a plurality of openings forming the cooling ducts.

The electrical switching device may be an electrical DC switching device. In this case, zero crossings may be created by means of an injection circuit.

Alternatively, the electrical switching device may be an electrical AC switching device.

The electrical switching device may be a contactor or a circuit breaker.

Generally, all terms used in the claims are to be interpreted according to their ordinary meaning in the technical field, unless explicitly defined otherwise herein. All references to "a/an/the element, apparatus, component, means, etc." are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
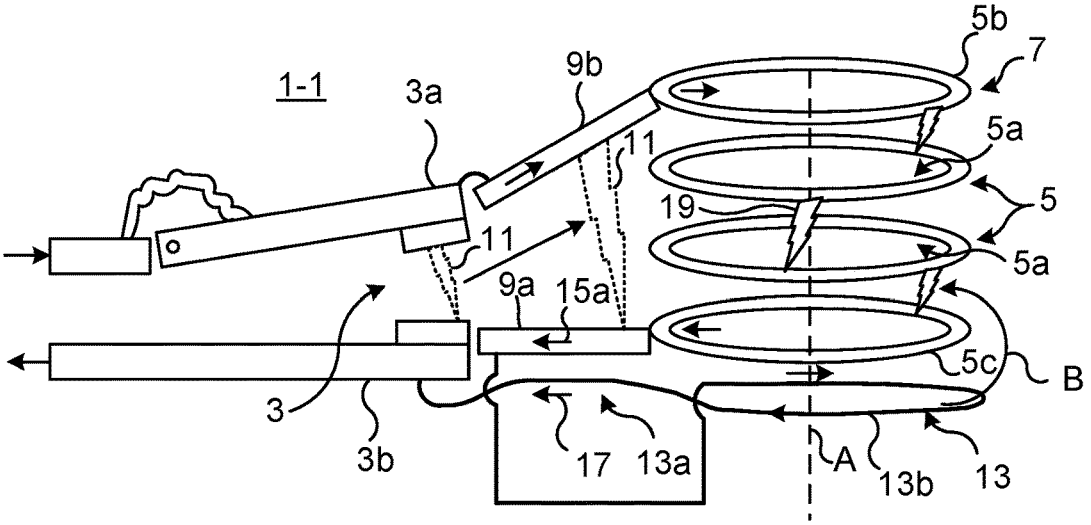
FIG. 1 schematically shows a side view of an example of an electrical switching device.

FIG. 1 shows an example of an electrical switching device 1-1. The electrical switching device 1-1 comprises a main contact arrangement 3 including a movable contact 3*a* and a fixed contact 3*b*.

The movable contact 3*a* is configured to be actuated between a closed position in which the movable contact 3*a* and the fixed contact 3*b* are in mechanical contact and an open position in which the movable contact 3*a* and the fixed contact are separated from each other. The open position is illustrated in FIG. 1.

The electrical switching device 1-1 furthermore comprises a plurality of splitter plates 5, 5*b*, 5*c*. Each splitter plate 5, 5*b*, 5*c* has a loop structure 5*a*. The splitter plates 5, 5*b*, 5*c* may hence have through-openings formed by the loop structure 5*a*. Alternatively, the splitter plates are solid, i.e. without through-openings. In this case an inner distancing element and an outer distancing element arranged concentrically with the inner distancing element may be provided between each pair of adjacent splitter plates, forming the loop structure.

The splitter plates 5 are stacked to form a stack of splitter plates 7. The stack of splitter plates 7 has a splitter plate which is a first outermost splitter plate 5*b* and a splitter plate which is a second outermost splitter plate 5*c*. The first outermost splitter plate 5*b* is the outermost splitter plate on one side of the stack of splitter plates 7. The second splitter plate 5*c* is the outermost splitter plate on the other side of the stack of splitter plates 7.

The splitter plates 5, 5*b*, 5*c* are stacked such that the loop structures 5*a* are arranged coaxially along an axis A. The splitter plates 5, 5*b*, 5*c* are stacked with an axial gap between each pair of adjacent splitter plate 5, 5*b*, 5*c*.

The splitter plates 5 may be made of a non-ferrous material such as copper or brass.

The electrical switching device 1-1 also comprises a first arc runner 9*a* and a second arc runner 9*b*. The first arc runners 9*a* and the second arc runner 9*b* are configured to direct a main arc 11 initially generated between the movable contact 3*a* and the fixed contact 3*b* when the movable contact 3*a* is set in the open position, to the stack of splitter plates 7.

The first arc runner 9*a* may be in direct mechanical contact with the second outermost splitter plate 5*c*. The first arc runner 9*a* may be integral with the second outermost splitter plate 5*c*. This may apply to any example disclosed herein. The second arc runner 9*b* may be in direct mechanical contact with the first outermost splitter plate 5*b*. The second arc runner 9*b* may be integral with the first outermost splitter plate 5*b*. This may apply to any example disclosed herein.

The electrical switching device 1-1 comprises a first drive coil 13. In this example, the first drive coil 13 is electrically connected to the first arc runner 9*a*. One end of the first drive coil 13 may be mechanically connected to the first arc runner 9*a*, which may form part of the second outermost splitter plate 5*c*. The drive coil 13 is electrically connected to the fixed contact 3*b*. The other end of the first drive coil 13 may be mechanically connected to the fixed contact 3*b*.

The first drive coil 13 has a first force increasing coil portion 13*a* which extends along and parallel with the first arc runner 9*a*, towards the fixed contact 3*b*. As an example, the main current 15*a* flowing through the first arc runner 9*a* during an arc extinguishing operation, may have a current path from the second outermost splitter plate 5*c* to the fixed contact 3*b* via the first arc runner 9*a*. The first force increasing coil portion 13*a* is arranged parallel with the first arc runner 9*a* in a manner such that the current 17 flowing through the first force increasing coil portion 13*a* flows parallel with and in the same direction as the main current 15*a* in the first arc runner 9*a*, i.e. towards the fixed contact 3*b*. The magnetic field is hence amplified, causing an increase in the blowing magnetic field for attracting the secondary arcs 19 into the stack of splitter plates 7.

The first drive coil 13 furthermore has a first rotating force coil portion 13*b* arranged adjacent to the second outermost splitter plate 5*c*. The first rotating force coil portion 13*b* is arranged along the loop or arranged to follow the loop of the second outermost splitter plate 5*c*. The first rotating force coil portion 13*b* is hence configured to create a blowing magnetic field in the stack of splitter plates 7, when energised. This causes the secondary arcs 19 to move circumferentially along the loop's structures 5*a* of the splitter plates 5.

The first drive coil 13 may be connected to an end portion of the first arc runner 9*a* in a region adjacent to the fixed contact 3*b*. The first drive coil 13 may be led back from its connection point with the first arc runner 9*a* towards the second outermost splitter plate 5*c* where it forms the first rotating force coil portion 13*b*. The first drive coil 13 may then be led adjacent to and in parallel with the first arc runner 9*a*, and connected electrically to the fixed contact 3*b*. The portion of the first drive coil 13 which is led back to the second outermost splitter plates 5*c* is preferably led further away from the first arc runner 9*a* than the first force increasing portion 13*a* and may for example be arranged to cross the first force increasing portion 13*a* only once in order to minimise its magnetic field effect in the gap between the first arc runner 9*a* and the second arc runner 9*b*.

The operation of the electrical switching device 1-1 will now be explained in more detail. As previously noted, in FIG. 1 the movable contact 3*a* have been set in the open position in a circuit breaking operation. The main arc 11 is hence created between the movable contact 3*a* and the fixed contact 3*b*. The main arc 11 subsequently jumps to the first arc runner 9*a* and the second are runner 9*b*. Once between the first arc runners 9*a* and the second arc runner 9*b*, the main arc 11 travels towards the stack of splitter plates 7. The current will in the open position of the movable contact 3*a* instead of flowing through the main contact arrangement 3 from the movable contact 3*a* to the fixed contact 3*b* flow though the movable contact 3*a* to the second arc runner 9*b* and further to the first outermost splitter plate 5*b*, and through the stack of splitter plates 7 to the second outermost splitter plate 5*c*. The main current 15*a* will then flow through the first arc runner 9*a* and back through the portion of the first drive coil 13 back to the first rotating force increasing portion 13*b* and then finally to the fixed contact 3*b* via first force increasing portion 13*a*. The first drive coil 13 is hence energised and the current 17 through the first rotating force coil portion 13*b* creates a rotating blowing magnetic field B in the stack of splitter plates 7 due to a tangential Lorentz force. The current 17 through the first force increasing coil portion 13*a* increases the magnetic field as it flows parallel with and in the same direction as the main current 15*a* in the first arc runner 9*a*. The main arc 11 is therefore attracted by Lorentz force to the stack of splitter plates 7, causing it to divide into the secondary arcs 19 which are rotated in the loop structures 5*a*.

As an alternative to the configuration described above, the first drive coil could instead be electrically connected to the first outermost splitter plate and to the movable contact.

Figure 2:
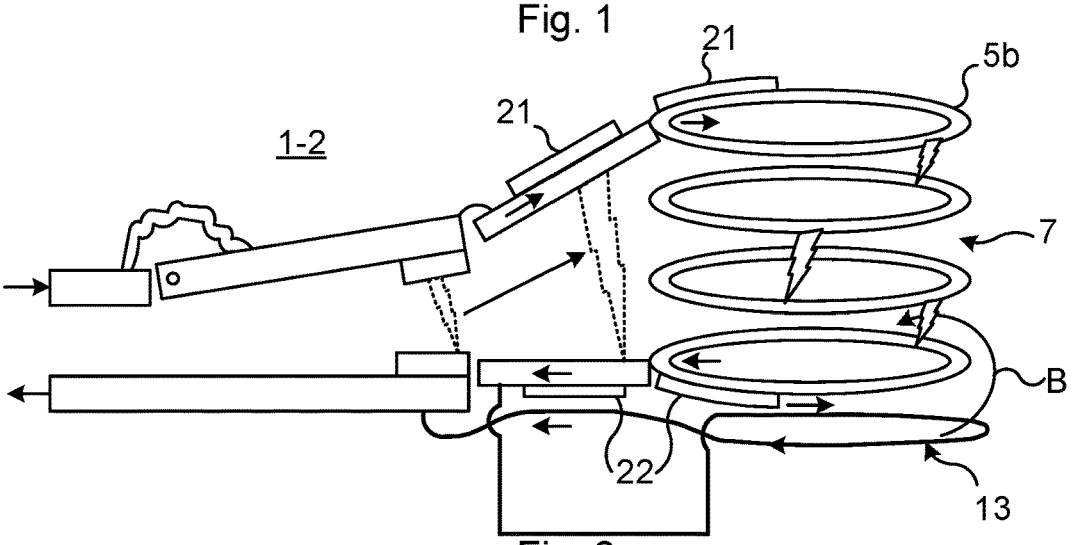
FIG. 2 schematically shows a side view of another example of an electrical switching device.

FIG. 2 shows another example of an electrical switching device. The electrical switching device 1-2 is similar to the electrical switching device 1-1. An outer surface of the second arc runner 9*b* of the electrical switching device 1-2 is however provided with a ferrous material 21, such as iron, steel or a steel alloy. The ferrous material may be a layer of ferrous material. The outer surface of the first outermost splitter plate 5*b* is also provided with a ferrous material 21, such as iron, steel or a steel alloy. An outer surface of the first arc runner 9*a* and an outer surface of the second outermost splitter plate 5*c* may also be provided with a ferrous material 22. The ferrous material may be a layer of ferrous material. In this manner, the magnetic field will be "warped" towards the interior of the stack of splitter plates 7, since the non-magnetic material will essentially act as a magnetic screen or shield in a direction away from the stack of splitter plates 7. Therefore, the magnetic field strength along the axis A may be increased, especially in the region far from the first drive coil 13.

Figure 3:
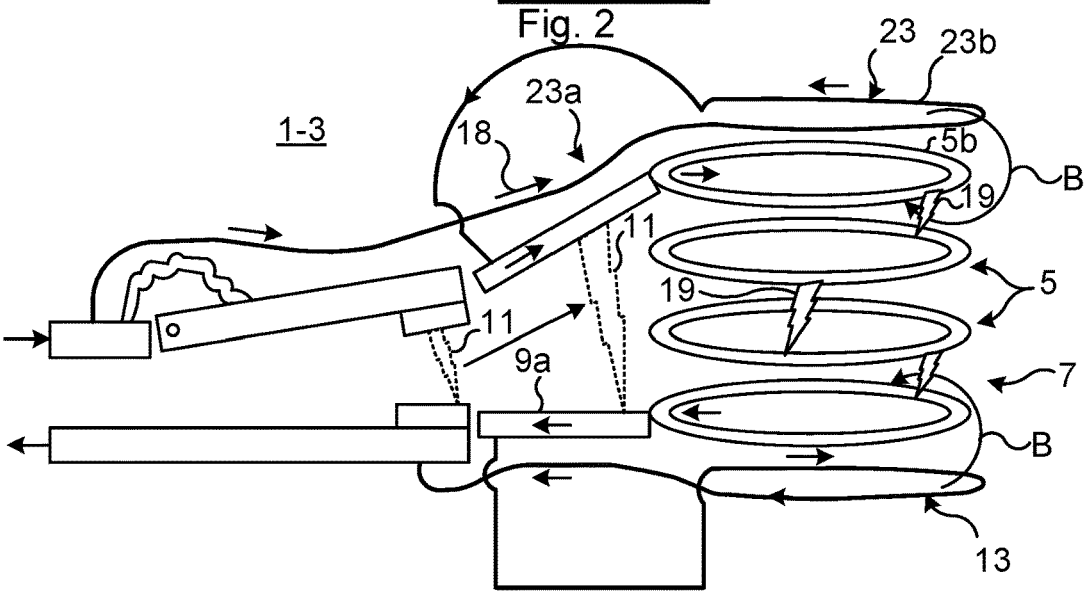
FIG. 3 schematically shows a side view of yet another example of an electrical switching device.

FIG. 3 shows yet another example of an electrical switching device. The electrical switching device 1-3 is similar to electrical switching device 1-1. Electrical switching device 1-3 however also comprises a second drive coil 23. The second drive coil 23 is electrically connected to the second arc runner 9*b* and hence to the first outermost splitter plate 5*b* and to the movable contact 3*a*. The second drive coil 23 has a second force increasing coil portion 23*a* extending along and in parallel with the second arc runner 9*b* in a direction towards the splitter plates 5, in particular towards the first outermost splitter plate 5*b*. The second force increasing coil portion 23*a* is configured such that a current flowing through it is parallel with and in the same direction as the direction of the main current 15*b* flowing through the second arc runner 9*b* towards the stack of splitter plates 7.

The second drive coil 23 furthermore has a second rotating force coil portion 23*b* arranged adjacent to the first outermost splitter plate 5*b*. The second rotating force coil portion 23*b* is arranged along the loop structure 5*a* of the first outermost splitter plate 5*b*. The second rotating force coil portion 23*b* is hence configured to create a blowing magnetic field in the stack of splitter plates 7, when energised. This causes the secondary arcs 19 to move circumferentially along the loop structures 5*a* of the splitter plates 5.

The second drive coil 23 may be led back from stack of splitter plates 7 where it forms the second rotating force coil portion 23*b* towards the movable contact 3*a* to an end portion of the second arc runner 9*b* in a region adjacent to the movable contact 3*a* where it is connected to the second arc runner 9*b*. The second drive coil 23 may be led back towards the movable contact 3*a* such that it crosses the second force increasing portion 23*a* for example once, and in a non-parallel manner relative to the second force increasing portion 23*a* and the second arc runner 9*b* in order to minimise its magnetic field effect in the gap between the first arc runner 9*a* and the second arc runner 9*b*.

The operation of the electrical switching device 1-3 is similar to that described above with regards to electrical switching device 1-1. A difference with electrical switching device 1-3 is that the main current 15*b* will flow first through the second force increasing portion 23*a*, then through the second rotating force coil portion 23*b*, and then backwards to the second arc runner 9*b* via a portion of the second drive coil 23 which is arranged at a distance from the second force increasing portion 23*a*, and onwards to the first outermost splitter plate 5*b* and the stack of splitter plates 7. The magnetic field and hence the Lorentz force is thereby increased. Additionally, as the current 18 flows through the second rotating force coil portion 23*b* of the second drive coil 23, a rotating blowing magnetic field is generated in the stack of splitter plates 7 due to a tangential Lorentz force.

Figure 4:
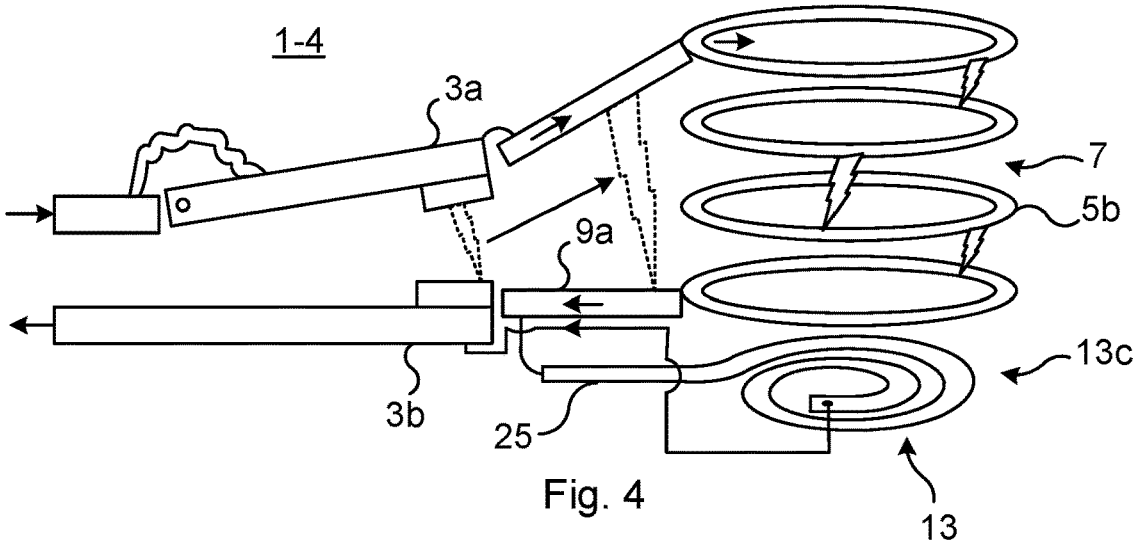
FIG. 4 schematically shows a side view of yet another example of an electrical switching device.

FIG. 4 shows yet another example of an electrical switching device. The electrical switching device 1-4 shown in FIG. 4 is similar to the electrical switching device 1-1 shown in FIG. 1. The first drive coil 13 is a first plate which has a spiral coil structure 13*c*. The first drive coil 13 may for example be made of a plate or sheet of metal. The first plate has a first stem portion 25. The first stem portion 25 may for example form part of the first arc runner 9*a*. The first force increasing coil portion 13*a* may be electrically and mechanically connected to the spiral coil structure 13 and to the fixed contact 3*b*. The spiral coil structure 13 may be electrically and/or mechanically connected to the first arc runner 9*a*.

Figure 5:
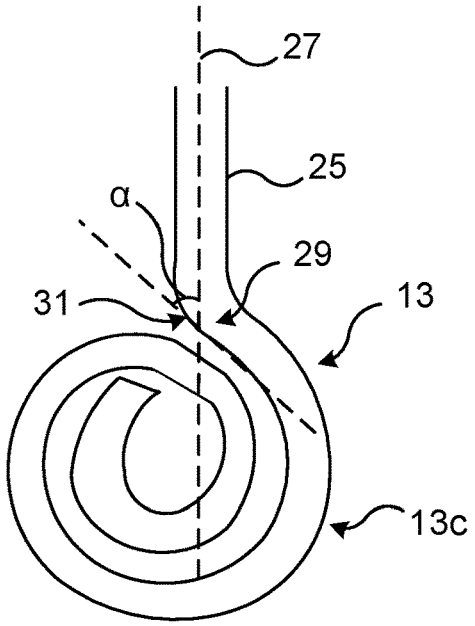
FIG. 5 schematically shows a top view of an example of a splitter plate.

FIG. 5 shows a top view of an example of the first drive coil 13 in the form of the first plate shown schematically in FIG. 4. The first stem portion 25 may have an essentially straight extension from the spiral coil structure 13*c* towards the fixed contact 3*b*. The first stem portion 25 may define a first stem portion axis 27. The first stem portion 25 transitions into the spiral coil structure 13*c* in a first transition region 29. The first transition region 29 has a first inner coil surface 31 in the coiling direction, which intersects the first stem portion axis 27 with an angle $\alpha$ of at most 80 degrees, such as at most 70 degrees, such as at most 60 degrees.

According to one example which includes two drive coils, the second drive coil may be similar to the first drive coil described above, but instead the second force increasing coil portion is electrically connected to the movable contact and to the second arc runner, similarly as in the example shown in FIG. 3.

Figure 6:
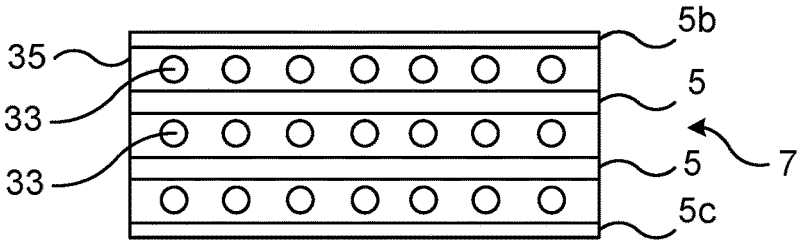
FIG. 6 schematically shows a side view of an example of an arc chamber.

FIG. 6 shows a side view of a stack of splitter plates 7. The stack of splitter plates 7 may form part of an arc chamber. The arc chamber may be utilised in any of the electrical switching devices 1-1, 1-2, 1-3, and 1-4 described herein.

Figure 7:
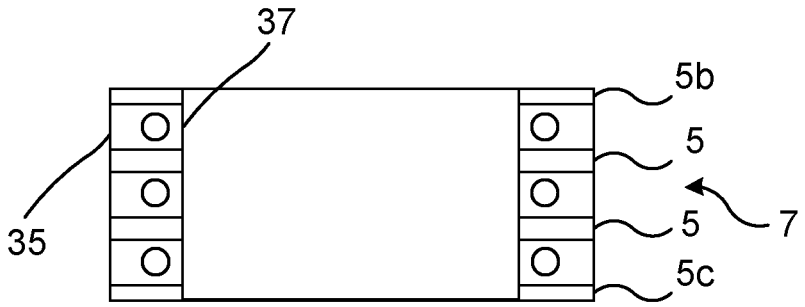
FIG. 7 schematically shows a cross-sectional view of the arc chamber depicted in FIG. 6.

The arc chamber comprises cooling ducts 33 configured to provide pressure relief inside the arc chamber. In the present example, the arc chamber comprises outer distancing elements 35 and inner distancing elements 37 (FIG. 7). The outer distancing elements 35 and the inner distancing elements may be made of a dielectric material. Each outer distancing element 35 and each inner distancing element is configured to act as a spacer between adjacent splitter plates 5, 5*b-c*. Each outer distancing element 35 is arranged concentrically with an inner distancing element, thereby forming, or forming part of a loop structure. The outer distancing elements 35 and the inner distancing elements are provided with a plurality of openings extending parallel with a plane defined by any of the stacked splitter plates 5, 5*b-c*. The openings form the cooling ducts 33.

As one alternative to the above-described configuration, the arc chamber could comprise an external housing, for example a dielectric housing, provided with a plurality of openings forming the cooling ducts.

The splitter plates may generally have any structure, preferably with rounded corners. The splitter plates may hence for example be circular or polygonal with rounded corners.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. An electrical switching device comprising:

a main contact arrangement including a fixed contact and a movable contact, a plurality of splitter plates, each having a loop structure, the splitter plates being coaxially stacked with respect to their loop structure to form a stack of splitter plates, wherein one of the splitter plates of the stack of splitter plates is a first outermost splitter plate and another one of the splitter plates of the stack of splitter plates is a second outermost splitter plate, a first arc runner electrically connected to the second outermost splitter plate and a second arc runner electrically connected to the first outermost splitter plate, the first arc runner and the second arc runner being configured to direct a main arc from the main contact arrangement to the stack of splitter plates to thereby split the main arc into a plurality of secondary arcs between the splitter plates, and a first drive coil electrically connected to the second arc runner and to the movable contact or to the first arc runner and to the fixed contact, wherein the first drive coil has a first force increasing coil portion extending in parallel with the first arc runner in a direction towards the splitter plates such that the first force increasing coil portion is able to carry current in the same direction as and in parallel with a main current flow in the first arc runner to increase the magnetic field to thereby increase the Lorentz force applied to the main arc between the first arc runner and the second arc runner, wherein the first drive coil, when energised, is configured to create a blowing magnetic field in the stack of splitter plates, causing the secondary arcs to move circumferentially along the loop's structures of the splitter plates.

2. The electrical switching device as claimed in claim 1, wherein the first drive coil is electrically connected to the first arc runner and the fixed contact.

3. The electrical switching device as claimed in claim 2, wherein an outer surface of the second arc runner and an outer surface of the first outermost splitter plate are provided with a layer of ferrous material, and an outer surface of the first arc runner and an outer surface of the second outermost splitter plate are provided with a layer of ferrous material.

4. The electrical switching device as claimed in claim 2, wherein the second drive coil is a second plate which has a spiral coil structure.

5. The electrical switching device as claimed in claim 4, wherein the second plate has a second stem portion having a second stem portion axis, wherein the second stem portion transitions into the spiral coil structure in a second transition region, wherein the second transition region has a second inner coil surface which intersects the second stem portion axis with an angle of at most 80 degrees.

6. The electrical switching device as claimed in claim 2, comprising a second drive coil electrically connected to the second arc runner and to the movable contact, wherein the second drive coil has a second force increasing coil portion extending in parallel with the second arc runner in a direction towards the splitter plates such that the second force increasing portion is able to carry current in the same direction as and in parallel with a main current flow in the second arc runner to increase the magnetic field to thereby increase the Lorentz force applied to the main arc between the first arc runner and the second arc runner.

7. The electrical switching device as claimed in claim 2, wherein the splitter plates are made of a non-ferrous material.

8. The electrical switching device as claimed in claim 2, wherein the first drive coil is a first plate which has a spiral coil structure.

9. The electrical switching device as claimed in claim 2, comprising an arc chamber, wherein the stack of splitter plates forms part of the arc chamber, and wherein the arc chamber includes cooling ducts.

10. The electrical switching device as claimed in claim 1, comprising a second drive coil electrically connected to the second arc runner and to the movable contact, wherein the second drive coil has a second force increasing coil portion extending in parallel with the second arc runner in a direction towards the splitter plates such that the second force increasing portion is able to carry current in the same direction as and in parallel with a main current flow in the second arc runner to increase the magnetic field to thereby increase the Lorentz force applied to the main arc between the first arc runner and the second arc runner.

11. The electrical switching device as claimed in claim 10, wherein the second drive coil, when energised, is configured to create a blowing magnetic field in the stack of splitter plates, causing the secondary arcs to move circumferentially along the loop structures of the splitter plates.

12. The electrical switching device as claimed in claim 1, wherein the splitter plates are made of a non-ferrous material.

13. The electrical switching device as claimed in claim 12, wherein the non-ferrous material is copper or brass.

14. The electrical switching device as claimed in claim 1, wherein the first drive coil is a first plate which has a spiral coil structure.

15. The electrical switching device as claimed in claim 14, wherein the first plate has a first stem portion having a first stem portion axis, wherein the first stem portion transitions into the spiral coil structure in a first transition region, wherein the first transition region has a first inner coil surface which intersects the first stem portion axis with an angle of at most 80 degrees.

16. The electrical switching device as claimed in claim 1, comprising an arc chamber, wherein the stack of splitter plates forms part of the arc chamber, and wherein the arc chamber includes cooling ducts.

17. The electrical switching device as claimed in claim 16, wherein the arc chamber comprises outer distancing elements and inner distancing elements, each inner distancing element being arranged concentrically with a corresponding outer distancing element, the outer distancing elements and the inner distancing elements being configured to distance adjacent splitter plates from each other, wherein the outer distancing elements and inner distancing elements are provided with the cooling ducts.

18. The electrical switching device as claimed in claim 17, wherein the arc chamber comprises an external housing provided with a plurality of openings forming the cooling ducts.

19. The electrical switching device as claimed in claim 16, wherein the arc chamber comprises an external housing provided with a plurality of openings forming the cooling ducts.

* * * * *